United States Patent [19]

Witte

[11] 4,045,879

[45] Sept. 6, 1977

[54] PROCESS FOR TREATING OIL CONTAINING VEGETABLE RAW MATERIALS

[75] Inventor: Johan Frederik Witte, Amsterdam-Nieuwendam, Netherlands

[73] Assignee: Stork Amsterdam B.V., Amstelveen, Netherlands

[21] Appl. No.: 658,995

[22] Filed: Feb. 18, 1976

Related U.S. Application Data

[63] Continuation-in-part of Ser. No. 443,844, Feb. 19, 1974, abandoned.

[30] Foreign Application Priority Data

Feb. 20, 1973 Netherlands ..... 7302358

[51] Int. Cl.[2] ..... F26B 3/00; F26B 5/00; C11B 1/04; C11B 1/10

[52] U.S. Cl. ..... 34/31; 99/451; 99/483; 426/417; 426/459; 426/461; 260/412.2; 260/412.4

[58] Field of Search ..... 426/313–314, 426/431, 506–511, 519–521, 417, 459, 461; 260/412.2, 412.4; 34/164, 217, 31; 99/483, 451

[56] References Cited

U.S. PATENT DOCUMENTS

| | | | |
|---|---|---|---|
| 217,053 | 7/1879 | Brooke | 34/164 |
| 2,726,253 | 12/1955 | Gastock et al. | 260/412.4 |
| 3,173,768 | 3/1965 | Witte | 34/164 |
| 3,457,851 | 7/1969 | Hibbard | 426/521 |
| 3,548,737 | 12/1970 | Evans | 99/235 |

*Primary Examiner*—Winston A. Douglas
*Assistant Examiner*—P. E. Konopka

[57] ABSTRACT

Process for treating oil containing vegetable raw material by the influence of moisture and heat, whereby during the exposure of a rather thin layer of the oil containing raw materials to a moisture and heat transfer fluid, the raw materials are subjected to a loosening movement by means of a vibration having a substantial vertical component. The frequency of the vibration is 200 – 400 and the vertical amplitude 10 to 40 mm.

7 Claims, 4 Drawing Figures

FIG. 1.

PROCESS FOR TREATING OIL CONTAINING VEGETABLE RAW MATERIALS

This application is a continuation in part application of my prior application 443,844, filedFeb. 19, 1974, now abandoned.

FIELD OF THE INVENTION

The invention relates to a process for treatment of finely divided materials particularly oil containing vegetable raw materials for extracting oil, by subjecting the material to the influence of moisture or heat and moisture.

BACKGROUND

According to a prior art process, oil containing seeds are heated in so-called cookers or flour boilers in the presence of moisture. Such a flour boiler consists of a vessel with a plurality of hollow plates disposed over each other, each provided with a passage opening for discharge material onto a plate situated thereunder. The oil containing seeds are essentially indirectly heated by the plates.

In order to extract oil from oil containing vegetable raw materials, like fruits or seeds, by squeezing or extracting by means of solvents it is necessary to expose these raw materials previously to a number of pre-treatments. Irrespective of the specific pre-treatments for each kind of seed and the differences owing to a choice between extracting or crushing, the following examples of pretreatments can be mentioned in arbitrary order of succession, i.e.: removal of shells, skins or husks, pulverizing, rolling, heating, drying and cooling.

In dependance of the raw material and the oil extraction process proper, one or more of these pre-treatments are required and some of them even simultaneously. Although the mechanisms between pre-treatment and oil-extraction are not yet entirely known one may explain that the pre-treatments effectuate that:

cell material is opened, whereby the oil is more easily released;

undesired components such as albumins, mucous materials and the like are fixed and become insoluble;

the rests of the cell walls are strengthened.

The known process suffers, however, from the disadvantage that the residence time of the product in the cookers or flour boilers often exceeds the optimally necessary time, while moreover a uniform well controlled treatment of the particles is impossible. This is caused by the very bad heat conduction and heat transfer, owing to the fact that in the known process the heat supply is substantially indirect, as it is effected through a heat exchanging surface, while besides, the heat conductivity of the product to be treated is very insufficient, because it is material in bulk that is exposed to the treatments.

SUMMARY OF THE INVENTION

It has now been found vegetable oil containing raw materials can also be efficiently treated with shorter residence times than required in the known methods. Apart therefrom the conditions under which the process is carried out are excellent, so that the raw materials are brought into an optimal condition for the further treatment of the oil therein. More generally it has been found that vegetable materials can be treated with heat or moisture or both in shorter times than in the prior art methods.

Thus the invention provides a process for treating parts of vegetable raw materials, particularly finely divided vegetable raw material for extracting oil, comprising a. subjecting the particles in a thin layer in a receiver provided with a bottom having closable apertures;

b. contacting the particles with each other regularly for a short time and separating the particles from each other for a short time while advancing said particles through the receiver, by subjecting the particles to a vertical component of vibration in which period said apertures in the bottom are opened;

c. periodically supplying a heat or moisture or both heat and moisture containing fluid through the bottom of the receiver during periods in which the apertures are open and while the particles traverse the receiver;

d. and optimally removing moisture after the treatment.

In this way an excellent heat and moisture transfer is acquired which involves a considerable reduction of the required treatment and residence times and a more uniformly controlled treatment of the vegetable raw material particles.

It should be noted that the vibration is not the vibration of a normal vibration gutter, which is used with frequences of 3000 and a total maximum amplitude of 1 mm, while the present invention is based on a frequency of at most 1000 and preferably 200 to 400 and a total amplitude which ranges from 5 to 50 and preferably from 10 to 40 mm. The total amplitude means the difference in level of the vibrating bottom of the receiver.

The vegetable raw materials in the shape of a rather thin layer are heated to a temperature of at least 95° C and preferably to 95°–115° C during preferably 1 to 3 minutes.

A very remarkable improvement is obtained which is connected with the fact that the particles contact each other regularly for a short time, due to mutual collision and that they are separated from each other for a short time, while the heat and moisture transfer fluid can easily act upon each individual particle.

During the removal of excess moisture, it is also advisable to have the particles contact each other regularly for a short time and to keep them apart for a short time.

The action of moisture or heat or both on the raw materials is effected by bringing the vegetable raw materials into direct contact with the fluids for the heat and moisture transfer. So as to obtain the desired conditions of the raw materials, one may arbitrarily use conditioned air with a temperature ranging from 15° to 150° C, steam, cold water, and the like. Due to the fact that these heat and moisture transfer fluids directly contact the raw materials, local superheating or even lump formation owing to local moisture accumulations, are avoided, Insofar as in the foregoing a rather thin layer is described this is understood to be a layer of several centimeters in thickness and preferably ranging from 1 to 10 cm in thickness.

DESCRIPTIION OF THE PREFERRED EMBODIMENTS

The process in question can be performed in a suitable way in a device of the type as described hereinafter with reference to the drawing wherein FIG. 1 is a side elevational view of part of a vibrating receiver in which the foremost portion is broken away and shown in section;

DETAILED DESCRIPTION

Figure 1:
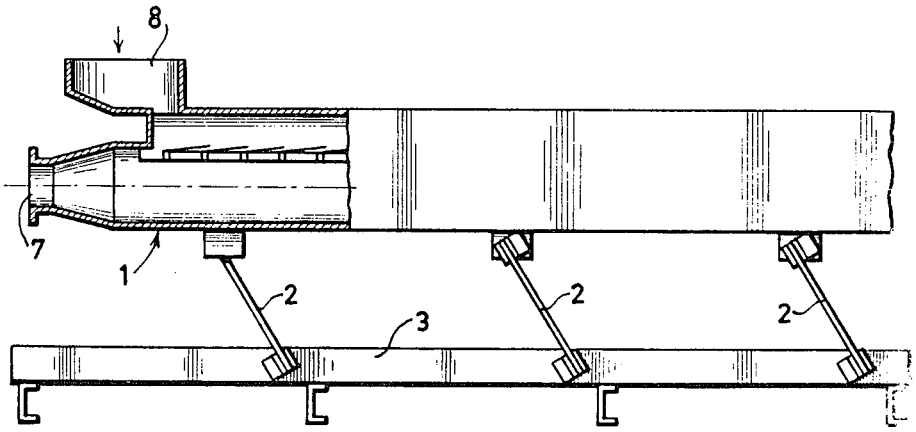
Figure 2:
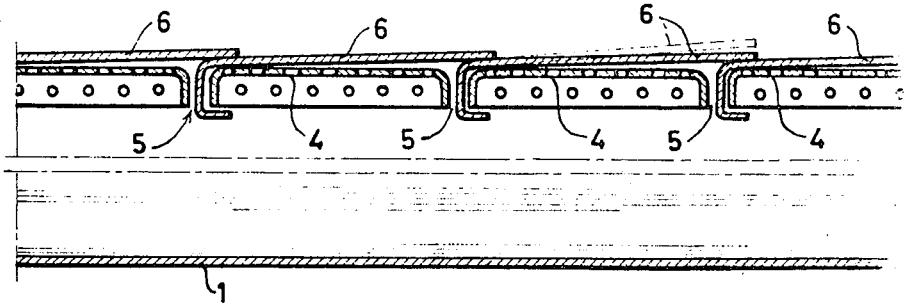
FIG. 2 is an enlarged sectional view of the conveying surface.
Figure 3:
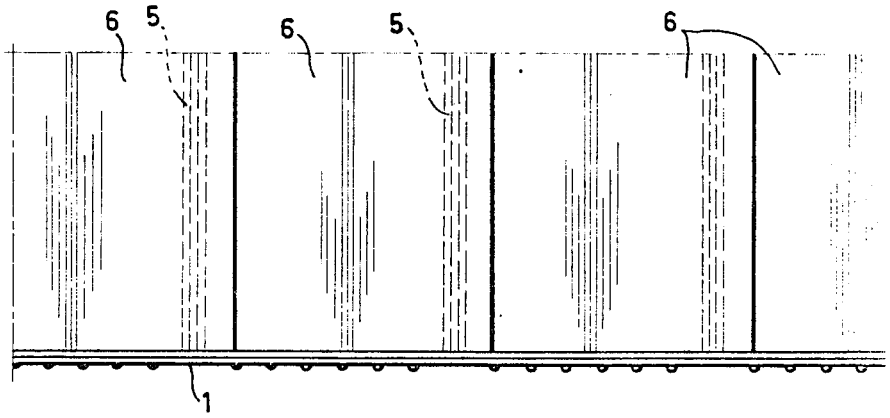
FIG. 3 is a plan view thereof.

In FIGS. 1 to 3 a receiver 1 is supported by flexible strips 2 which at their lower ends are secured to the base 3 and at their upper end are connected to the receiver. In the receiver 1 strips 4 of perforated metal are secured between the side walls of the casing. Said strips constitute a horizontal bottom surface and between each pair of adjacent strips a strip 6 of thin flexible sheet material, such as rubber, is secured at 5 and extends on the one metal strip 4 to adjacent flexible strip 6.

The receiver 1 has at one of its ends a connection 7 for a conduit for supplying gas and/or steam for treating the material in the receiver. The material is introduced into the receiver 1 at inlet above the conveying surface constituted by the flexible strips 6.

The receiver 1 together with the conveying surface is vibrated with a frequency between 200 and 400, e.g. 300 and the maximum amplitude is at least 5 mm and at most 40 mm e.g. an appropriate value being 20 mm. Due to the vibration, the material is conveyed on the conveying surface. The conditioned gas and/or steam is blown through perforations of the bottom constituted by the strips 4 and slightly urges the flexible strips 6 away from said bottom of the gutter so that they are floating. Said strips 6, however, always fall down onto the bottom of the receiver so that a horizontal surface is maintained. Instead of perforated strips 4 a single continuous sheet of wire gauze or other pervious material may be used.

The broken oil seed particles 9 to be treated are subjected to the action of steam of 150° C in order to moisten and to heat the oil seed particles to a temperature of at least 95° C in order to inactivate the enzymes.

On the other hand for maintaining the nutritional value of other proteins temperatures of 115° C should be maximum, if possible. In practice the seed particles are held 1–3 minutes between 95° and 115° C.

The particular way of treating broken oil seeds provides a product from which oil is extracted very easily. The finer of the oil seeds form small aggregates which are easily extractable.

If for example, vibrations having a frequency of 3000 and a maximum amplitude of 1 mm are used, the seed material will be compacted and rather high amounts of oil cannot be extracted.

Figure 4:
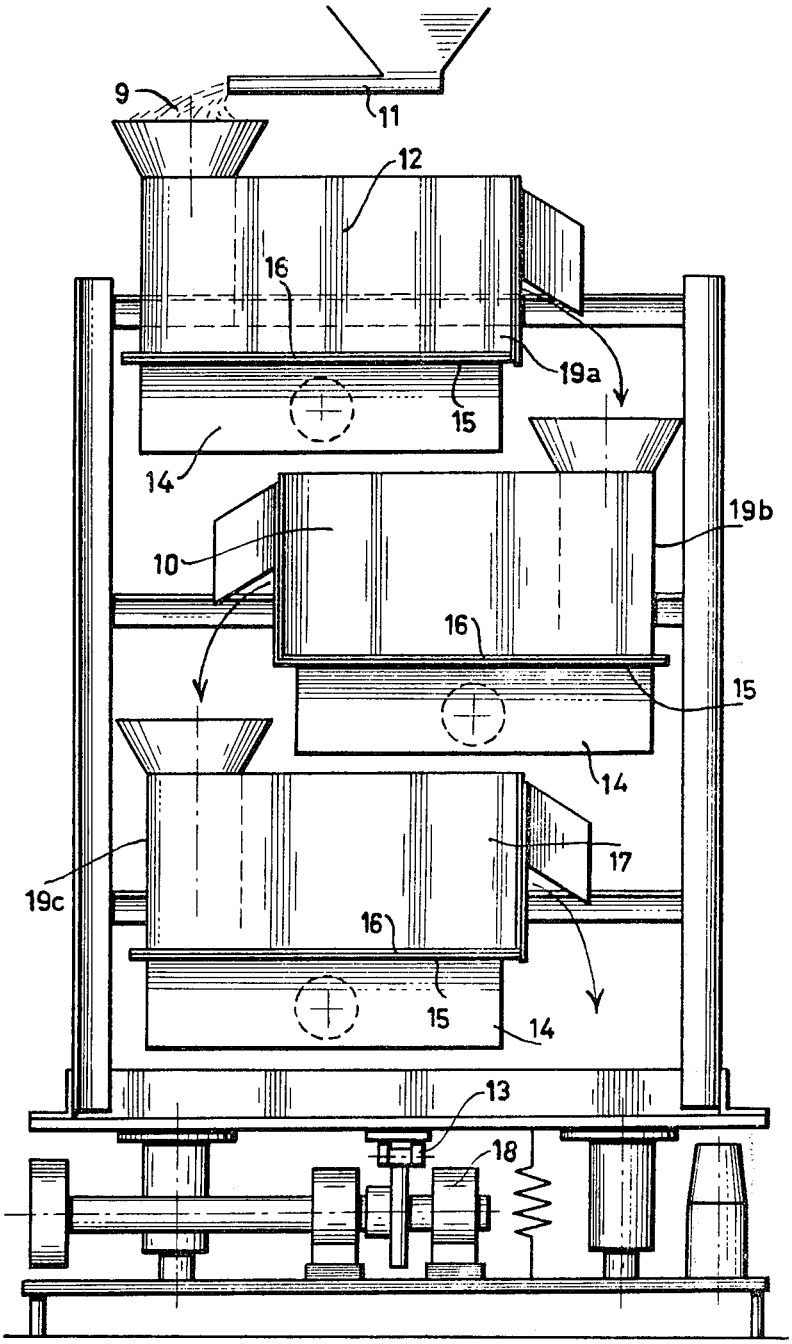
FIG. 4 is an elevational view of another embodiment of an apparatus for performing the method of the invention.

The material 9 to be treated, e.g. beans, seeds or fruits, whether previously broken, shelled and rolled or not, can also be fed to a feeding and metering system 11 of the device, shown in FIG. 4. In the first part 12 of this continuously operating device, the raw materials 9 can be simultaneously moistened and heated in a device according to FIGS. 1—3, by means of steam through pipe 14. For that purpose this part is divided into various sections 15 to which through perforated bottoms 16, both steam and heated air can be supplied. The transport in the device is performed by a combination of the overflow principle and a vibration of the vibrating device according to FIG. 1, while heat and moisture is supplied. As a result one can considerably reduce the time during which the raw materials stay in this part, in order to attain the process conditions which are desired for the second stage of the treatment. Usually raw materials do not stay longer than 5 minutes in this part, contrary to the time required in the conventional cookers, for this part of the treatment, which is in the range of 5 to 20 minutes. At a second stage of the treatment 19*b* the maximal temperature of the raw materials is maintained for 1 to 3 minutes at a value ranging from 95° to 115° C. Due to a proper control of the process, that is to say a uniform regulation of the temperature, one avoids at this stage, too, that the residence time of the materials in this part of the device, exceeds optimal values. After the second stage of the treatment the raw materials are introduced into the third part 17. In this part the moisture content and the temperature of the raw materials are again reduced to values required for the extraction or crushing. In this case, too, a transporting vibration as disclosed hereinbefore is used, whereby the particles are temporarily held apart, while the transfer of heat and moisture is effected in a more or less loosened state by means of conditioned air.

According to the invention it is now possible to work with:

a. very short and uniform residence times comprised between 2 and 10 minutes for the whole treatment, contrary to the conventional residence times comprised between 20 and 45 minutes, while in order to attain the desired conditions of the raw materials, arbitrarily conditioned air with a temperature between 15° and 150° C, steam or cold water can be used.

b. direct contact between the heat and moisture transfer fluid and the raw materials, whereby local superheating or lump formation by local moisture accumulations are avoided.

Preferably the device according to FIG. 4 comprises vibratory conveyors 19*a*, 19*b* and 19*c* disposed in a cascade configuration, each associated with an eccentric 13 which from a central drive 18 provides for the vibration action. In vibratory conveyors of this type it is possible to treat materials with a large quantity of moisture, without any risk of crusting or obturation of perforated bottoms, though which steam, hot or cold, dry or wet, air can be passed at will.

It should be noted that due to the vibratory motion of the vibratory conveyors a certain loosening effect is produced which is enhanced by the gas (steam or air), supplied through the bottom of the vibratory conveyor.

The frequency of 200 to 400 means 200–400 vibrations/min.

What I claim is:

1. A process for treating oil-containing vegetable seed particles to facilitate subsequent oil extraction from said particles, said process comprising the steps of:

a. forming the seed particles in a thin layer in a receiver provided with a bottom having apertures;

b. moving the particles close to one another regularly for a relatively short time and moving the particles away from one another for a relatively short time while advancing said particles through the receiver;

c. the movement of said particles towards and away from one another being obtained by effecting vibration of the receiver with a vertical vibration component having a low frequency of most 1000 vibrations per minute and high amplitude of about 5 to about 50 mm.;

d. supplying a heat and moisture-containing gaseous fluid through the apertures in the bottom of the receiver during periods in which the apertures are open;

e. heating the particles to a temperature of at least 90° C to inactivate enzymes rapidly;

f. thereafter decreasing the moisture content and temperature of the vegetable seed particles, by contacting the particles with each other regularly for a relatively short time and separating said particles from each other also for a relatively short time, said contact and said separation being obtained as in step (c), while a gaseous drying fluid supplied through openings in the bottom acts discontinuously on each individual particle when said oenings are open due to the action of the vertical vibration component.

2. Process according to clalim 1, wherein the oil-containing vegetable seed particles are heated and moistened in a first receiver, in a second receiver their temperature is maintained at a value ranging from 95° to 115° C for 1 to 3 minutes and in a third receiver the raw materials are cooled and dried, the fluids for the heating, moistening and transfer being supplied in each stage.

3. Process according to claim 1, wherein the total amplitude of the vertical component of vibration is between 10 and 40 mm.

4. Process according to claim 1, wherein the frequency of the vibration is between 200 to 400 vibrations per minute.

5. Process according to claim 1, wherein the oil containing vegetable seed particles in the thin layer are heated to a temperature of at least 90° C by supplying moisture and heat.

6. Process according to claim 1, wherein the heat and moisture transfer is effected by means of steam.

7. Process according to claim 1, wherein the vegetable seed particles are heated to a temperature between 95° and 115° .

* * * * *